US009717313B2

(12) United States Patent
Tsai

(10) Patent No.: US 9,717,313 B2
(45) Date of Patent: Aug. 1, 2017

(54) SUNSHADE AND METHOD OF PREPARING A CANOPY

(71) Applicant: Yen-Lin Tsai, Taichung (TW)

(72) Inventor: Yen-Lin Tsai, Taichung (TW)

( * ) Notice: Subject to any disclaimer, the term of this patent is extended or adjusted under 35 U.S.C. 154(b) by 187 days.

(21) Appl. No.: 14/314,687

(22) Filed: Jun. 25, 2014

(65) Prior Publication Data

US 2015/0374084 A1 Dec. 31, 2015

(51) Int. Cl.

| | |
|---|---|
| ***A45B 25/18*** | (2006.01) |
| ***D03D 1/00*** | (2006.01) |
| ***D06N 3/00*** | (2006.01) |
| ***D06N 3/04*** | (2006.01) |
| ***D06N 3/14*** | (2006.01) |

(52) U.S. Cl.

CPC ..... *A45B 25/18* (2013.01); *D03D 1/007* (2013.01); *D06N 3/0006* (2013.01); *D06N 3/0063* (2013.01); *D06N 3/0065* (2013.01); *D06N 3/042* (2013.01); *D06N 3/14* (2013.01); *D06N 2201/12* (2013.01); *D06N 2209/0823* (2013.01); *D06N 2209/0853* (2013.01); *D06N 2211/12* (2013.01)

(58) Field of Classification Search

USPC ..... 135/33.2; 427/389.2

See application file for complete search history.

(56) References Cited

U.S. PATENT DOCUMENTS 5,985,773 A * 11/1999 Lee ..... D06N 3/14 442/131
2005/0261408 A1* 11/2005 Bauer ..... D06N 3/0063 524/409
2006/0003650 A1 1/2006 Lube

FOREIGN PATENT DOCUMENTS

| | | |
|---|---|---|
| EP | 0410055 A1 | 1/1991 |
| EP | 0807708 A2 | 11/1997 |
| EP | 0913518 A1 | 5/1999 |

OTHER PUBLICATIONS

Extended European Search Report issued in corresponding European Application No. 14173986.2 dated Dec. 18, 2014 (6 pages).

* cited by examiner

*Primary Examiner* — Lynda Salvatore
(74) *Attorney, Agent, or Firm* — Osha Liang LLP

(57) ABSTRACT

A sunshade includes: a support frame; and a canopy connected to the support frame and including a light-transmissible fabric sheet of undyed yarns and an opaque enamel coating coated on at least one side of the fabric sheet. A method of preparing a canopy includes: providing a light-transmissible fabric sheet of undyed yarns; coating an enamel composition on at least one side of the light-transmissible fabric sheet to form an opaque enamel coating on the light-transmissible fabric sheet; and drying the opaque enamel coating.

3 Claims, 7 Drawing Sheets

SUNSHADE AND METHOD OF PREPARING A CANOPY

BACKGROUND OF THE INVENTION

1. Field of the Invention

This invention relates to a sunshade and a method of preparing a canopy, more particularly to a sunshade with a canopy which includes a light-transmissible fabric sheet of undyed yarns and an opaque enamel coating.

2. Description of the Related Art

A conventional method for preparing a canopy of a sunshade with waterproof and sunshade functions includes a step of coating a waterproof coating material on a fabric sheet of dyed yarns.

Formation of the dyed yarns involves immersing undyed yarns into a dyeing bath. During the dyeing process, dye enters an interior of each fiber of the undyed yarns so as to impart an opaque property to the dyed yarns. The preparation of the canopy requires the dyeing of the undyed yarns and the coating of the waterproof coating material to be processed separately, which complicates the process of preparing the canopy. Moreover, the dyeing process results in generation of a considerable amount of dyeing waste water, which is difficult to be disposed of.

SUMMARY OF THE INVENTION

Therefore, an object of the present invention is to provide a sunshade that can overcome the aforesaid drawbacks associated with the prior art.

Another object of the present invention is to provide a method of preparing a canopy of the sunshade.

According to one aspect of the present invention, there is provided a sunshade comprising: a support frame and a canopy. The canopy is connected to the support frame and includes a light-transmissible fabric sheet of undyed yarns and an opaque enamel coating coated on at least one side of the light-transmissible fabric sheet. The undyed yarns are woven and cross one another to form fabric pores there among. The opaque enamel coating fills the fabric pores.

According to another aspect of this invention, there is provided a method of preparing a canopy. The method comprises: providing a light-transmissible fabric sheet of undyed yarns; coating an enamel composition on at least one side of the light-transmissible fabric sheet to form an opaque enamel coating on the light-transmissible fabric sheet; and drying the opaque enamel coating.

BRIEF DESCRIPTION OF THE DRAWINGS

In drawings which illustrate embodiments of the invention.

DETAILED DESCRIPTION OF THE PREFERRED EMBODIMENTS

Figure 1:
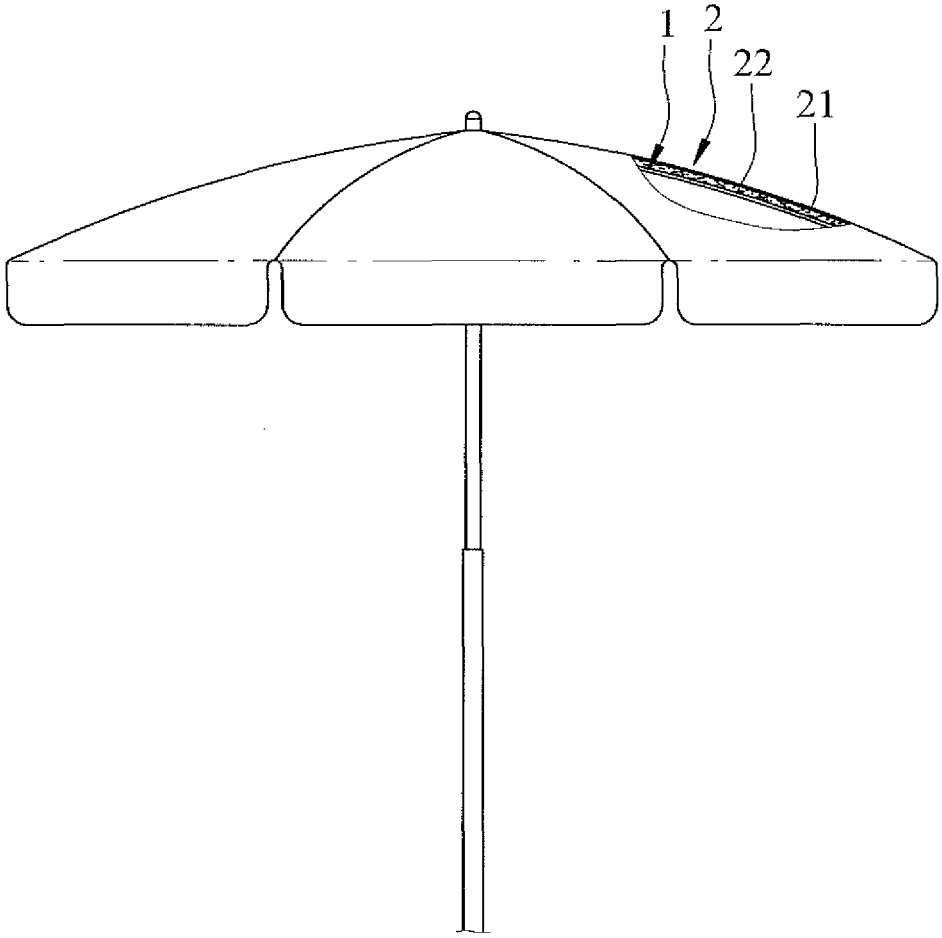
FIG. 1 is a partly sectional view of the first preferred embodiment of a sunshade according to the present invention.

Before the present invention is described in greater detail with reference to the accompanying preferred embodiments, it should be noted herein that like elements are denoted by the same reference numerals throughout the disclosure.

Figure 2:
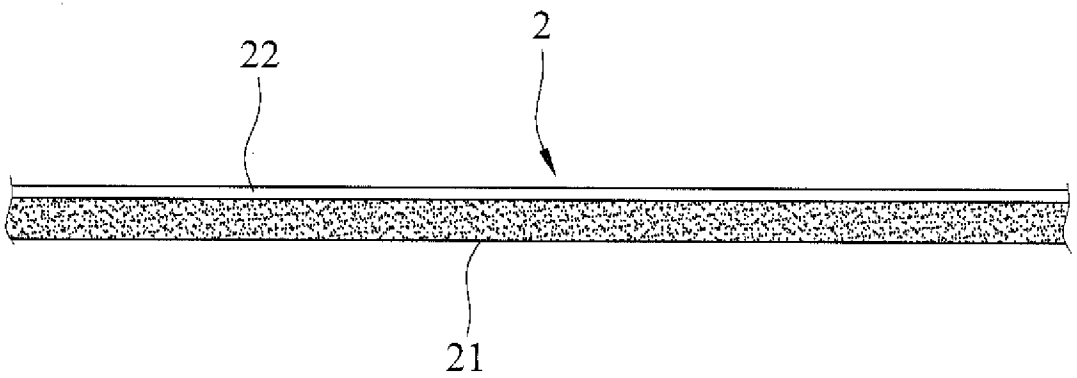
FIG. 2 is a sectional view of a canopy of the sunshade of the first preferred embodiment.
Figure 3:
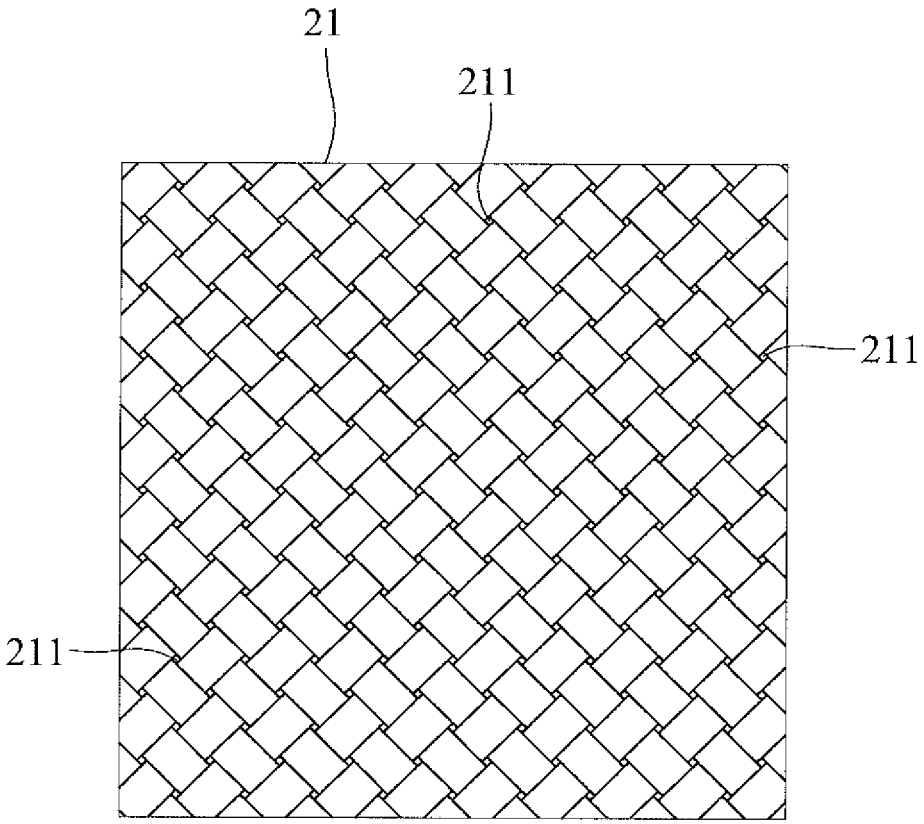
FIG. 3 is an enlarged schematic view of a light-transmissible fabric sheet of the canopy of the first preferred embodiment.

FIGS. 1, 2 and 3 illustrate the first preferred embodiment of a sunshade according to the present invention. The sunshade includes a support frame 1 and a canopy 2 connected to the support frame 1. The structure and shape of the support frame 1 are not limited. The sunshade may be portable, such as an umbrella, or fixed, such as a garden sunshade.

The canopy 2 includes a light-transmissible fabric sheet 21 of undyed yarns and an opaque enamel coating 22 coated on one side of the light-transmissible fabric sheet 21.

Preferably, the light-transmissible fabric sheet 21 is a woven fabric. The undyed yarns are woven and cross one another to form fabric pores 211 thereamong. The opaque enamel coating 22 fills the fabric pores 211, and covers sealingly the undyed yarns at said one side of the light-transmissible fabric sheet 21, so that said one side of the light-transmissible fabric sheet 21 is waterproof and opaque.

Preferably, the opaque enamel coating 22 includes a pigment and polyurethane-acrylic polymer. More preferably, the opaque enamel coating 22 includes hexamethylene diisocyanate (HDI).

The undyed yarns are preferably made from a material selected from the group consisting of polyvinyl chloride, polyurethane, aliphatic diisocyanate, and combinations thereof. Aliphatic diisocyanate may be hexamethylene diisocyanate (HDI). More preferably, the undyed yarns are made from HDI.

Figure 4:
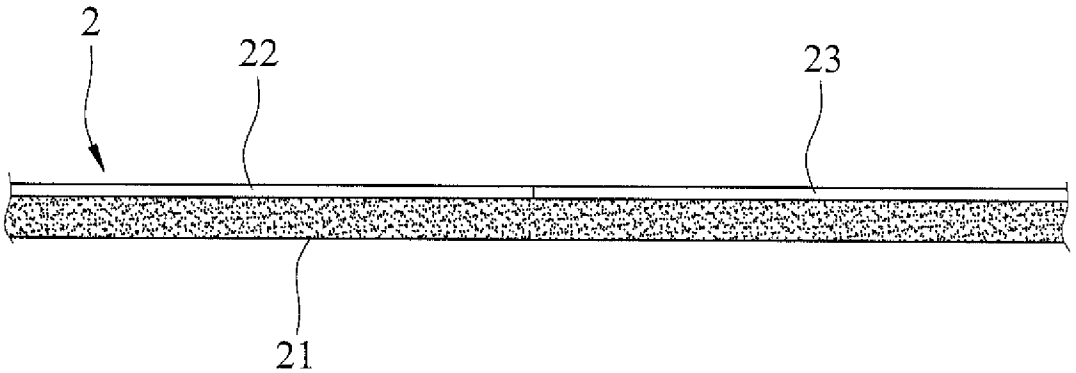
FIG. 4 is a sectional view of the second preferred embodiment of the canopy of the sunshade according to the present invention.

FIG. 4 illustrates the second preferred embodiment of the sunshade according to the present invention. The second preferred embodiment differs from the first preferred embodiment in that said one side of the light-transmissible fabric sheet 21 is coated with two different opaque enamel coatings 22, 23 at two different regions, respectively. Compositions of the opaque enamel coatings 22, 23 are different, so that the two different regions of the light-transmissible fabric sheet 1 have different colors and/or properties.

Figure 5:
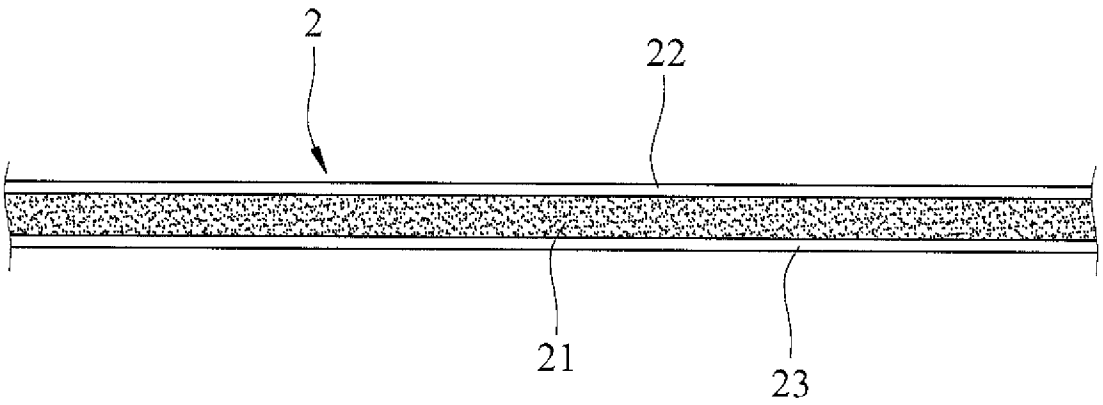
FIG. 5 is a sectional view of the third preferred embodiment of the canopy of the sunshade according to the present invention.

FIG. 5 illustrates the third preferred embodiment of the sunshade according to the present invention. The third preferred embodiment differs from the second preferred embodiment in that the two opaque enamel coatings 22, 23 are coated on two opposite sides of the light-transmissible fabric sheet 21, respectively.

Figure 6:
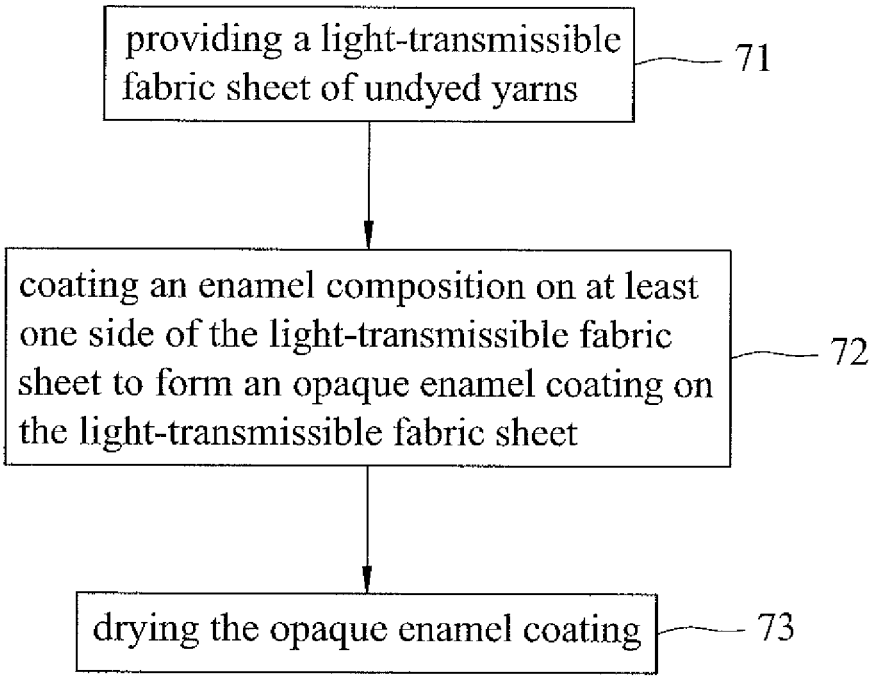
FIG. 6 is a flow chart of a method of preparing the canopy of the present invention.

FIG. 6 illustrates consecutive steps of a method for preparing the canopy 2 of the sunshade of the first preferred embodiment according to the present invention.

The method includes the steps of: providing a light-transmissible fabric sheet 21 of undyed yarns (step 71); coating an enamel composition 20 on at least one side of the light-transmissible fabric sheet 21 to form an opaque enamel coating 22 on the light-transmissible fabric sheet 21 (step 72); and drying the opaque enamel coating 22 (step 73).

Figure 7:
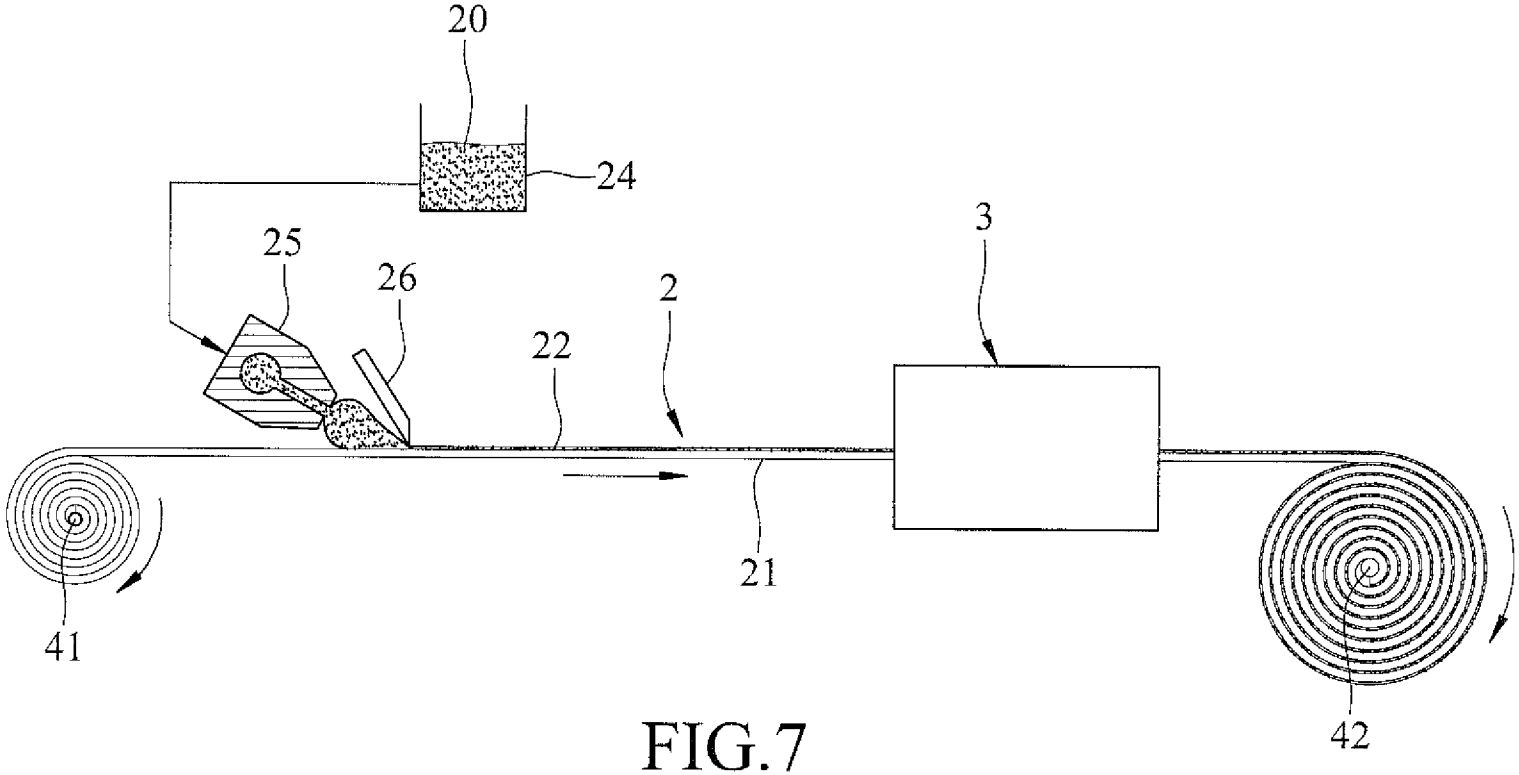
FIG. 7 is a schematic view of a processing system that can be used in the method of preparing the canopy of the present invention.

FIG. 7 illustrates a processing system that can be used in the method of the present invention shown in FIG. 6. As shown in FIGS. 6 and 7, in step 71, a supply reel 41 is provided for supplying the light-transmissible fabric sheet 21 to undergo subsequent coating and drying operations. The enamel composition 20 is stored in a tank 24. When conducting coating of step 72, the enamel composition 20 is guided to one side of the light-transmissible fabric sheet 21 using a die head 25, followed by spreading the enamel composition 20 using a scraper 26 so that the opaque enamel coating 22 is uniformly coated on the light-transmissible fabric sheet 21. In step 73, a dryer 3 is provided for drying the opaque enamel coating 22 on the continuous light-transmissible fabric sheet 21 processed by the scraper 26 so as to obtain the canopy 2. A pickup reel 42 is provided for collecting the canopy 2 thus obtained.

Preferably, the enamel composition 20 includes a pigment, polyurethane-acrylic polymer, and a solvent. Based on the total weight of the enamel composition 20, the pigment is in an amount ranging from 12 to 17 wt %, the polyurethane-acrylic polymer is in an amount ranging from 40 to 60 wt %, and the solvent is in an amount ranging from 20 to 40 wt %. More preferably, the amount of the pigment is 15 wt %, the amount of the polyurethane-acrylic polymer is 50 wt %, and the amount of the solvent is 35 wt %.

Examples of the solvent are dimethylformamide (DMF) and toluene.

Preferably, the enamel composition 20 further includes a cross-linking agent. The cross-linking agent is in an amount ranging from 1 to 4 wt % of the total weight of the enamel composition 20.

Preferably, the method of preparing the canopy 2 further includes dipping the light-transmissible fabric sheet 21 coated with the opaque enamel coating 22 into a hot water bath (not shown) to wash away excess opaque enamel coating 22 before drying the opaque enamel coating 22, followed by dipping the light-transmissible fabric sheet 21 coated with the opaque enamel coating 22 into a cold water bath (not shown) to cool and solidify the opaque enamel coating 22. The temperature of the hot water bath ranges from 100 to 120° C., and the temperature of the cold water bath ranges from 30 to 50° C.

Preferably, drying of the opaque enamel coating 22 is conducted by subjecting the opaque enamel coating 22 on the continuous light-transmissible fabric sheet 21 to a hot air blowing treatment.

The advantages of the present inventions can be summarized as follows. As compared to the method of preparing the conventional canopy, both the opaque and waterproof properties are imparted to the light-transmissible fabric sheet 21 in only one single step, i.e., the step of coating the opaque enamel coating 22 on the light-transmissible fabric sheet 21, and undyed yarns of the light-transmissible fabric sheet 21 are not required to undergo the dyeing process in advance, thereby eliminating the aforesaid problem of generation of dyeing waste water. In addition, the method of the present invention allows coating of the light-transmissible fabric sheet 21 at different regions thereof with different colors of the opaque enamel coatings 22 so as to permit formation of various designs and features on the light-transmissible fabric sheet 1.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A method of preparing a canopy, comprising:

providing a light-transmissible fabric sheet of undyed yarns;

coating an enamel composition on at least one side of the light-transmissible sheet to form an opaque enamel coating on the light-transmissible fabric sheet;

drying the opaque enamel coating; and dipping the light-transmissible fabric sheet coated with the opaque enamel coating into a hot water bath before drying the opaque enamel coating, followed by dipping the light-transmissible fabric sheet coated with the opaque enamel coating into a cold water bath, wherein the temperature of the hot water bath ranges from 100 to 120° C., and the temperature of the cold water bath ranges from 30 to 50° C.

2. The method of claim 1, wherein the enamel composition includes a pigment, polyurethane-acrylic polymer, and a solvent, and wherein, based on the total weight of the enamel composition, the pigment is in an amount ranging from 12 to 17 wt %, the polyurethane-acrylic polymer is in an amount ranging from 40 to 60 wt %, and the solvent is in an amount ranging from 20 to 40 wt %.

3. The method of claim 1, wherein drying of the opaque enamel coating is conducted by subjecting the opaque enamel coating to a hot air blowing treatment.

* * * * *